US010101706B2

(12) United States Patent
Yokoi

(10) Patent No.: US 10,101,706 B2
(45) Date of Patent: Oct. 16, 2018

(54) IMAGE-FORMING APPARATUS INCLUDING FRAME TO WHICH DEVELOPING CARTRIDGE HAVING ELECTRICAL CONTACT SURFACE IS ATTACHABLE TOGETHER WITH DRUM CARTRIDGE

(71) Applicant: BROTHER KOGYO KABUSHIKI KAISHA, Nagoya-shi, Aichi-ken (JP)

(72) Inventor: Junichi Yokoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/804,047

(22) Filed: Nov. 6, 2017

(65) Prior Publication Data

US 2018/0181058 A1 Jun. 28, 2018

(30) Foreign Application Priority Data

Dec. 28, 2016 (JP) ..... 2016-255339

(51) Int. Cl.
*G03G 21/18* (2006.01)
*G03G 15/08* (2006.01)
*G03G 15/00* (2006.01)

(52) U.S. Cl.
CPC ..... *G03G 21/1867* (2013.01); *G03G 15/0872* (2013.01); *G03G 15/751* (2013.01); *G03G 21/1842* (2013.01)

(58) Field of Classification Search
CPC ..... G03G 21/1867; G03G 21/1842; G03G 15/0872; G03G 15/751
See application file for complete search history.

(56) References Cited

U.S. PATENT DOCUMENTS

2011/0064457 A1 3/2011 Okabe et al.
2013/0051849 A1 2/2013 Itabashi et al.
2014/0086597 A1* 3/2014 Tanabe ..... G03G 21/1867 399/12
2014/0093279 A1* 4/2014 Hayakawa ..... G03G 21/1821 399/117
2017/0184998 A1* 6/2017 Itabashi ..... G03G 15/0865

FOREIGN PATENT DOCUMENTS

JP 2011-59510 A 3/2011
JP 2013-54058 A 3/2013

* cited by examiner

*Primary Examiner* — Rodney Bonnette
(74) *Attorney, Agent, or Firm* — Merchant & Gould P.C.

(57) ABSTRACT

An image-forming apparatus includes a developing cartridge, a drum cartridge, an electrical contact, a frame to which the developing cartridge attached to the drum cartridge is attachable, and first and second guide portions. The developing cartridge includes a storage medium having an electrical contact surface, and a holder including: a first outer surface holding the electrical contact surface, a second outer surface, and a resilient member connected to the both outer surfaces. The drum cartridge includes a holder support portion. The frame allows the developing cartridge to move from a first position to a second position, and then to a third position during insertion of the developing cartridge into the frame. The first guide portion guides the first outer surface, and the second guide portion guides the holder support portion to allow the electrical contact surface to contact the electrical contact during insertion of the developing cartridge into the frame.

9 Claims, 12 Drawing Sheets

IMAGE-FORMING APPARATUS INCLUDING FRAME TO WHICH DEVELOPING CARTRIDGE HAVING ELECTRICAL CONTACT SURFACE IS ATTACHABLE TOGETHER WITH DRUM CARTRIDGE

CROSS REFERENCE TO RELATED APPLICATION

This application claims priority from Japanese Patent Application No. 2016-255339 filed Dec. 28, 2016. The entire content of the priority application is incorporated herein by reference.

TECHNICAL FIELD

The present disclosure relates to an image-forming apparatus.

BACKGROUND

There are conventionally known electro-photographic type image-forming apparatuses such as a laser printer and an LED printer. Such an image-forming apparatus includes a developing cartridge including a developing roller for supplying toner.

A prior art discloses an image-forming apparatus including a drawer unit provided with a photosensitive drum. A developing cartridge is attached to the drawer unit. Upon attachment of the developing cartridge to the drawer unit, the photosensitive drum and the developing roller are in contact with each other.

Another prior art discloses an image-forming apparatus including a drum cartridge to which a developing cartridge is attached. The drum cartridge includes a photosensitive drum. Upon attachment of the developing cartridge to the drum cartridge, the developing cartridge and the photosensitive drum are in contact with each other. The drum cartridge to which the developing cartridge is attached is then attached to the image-forming apparatus.

SUMMARY

Further, a developing cartridge including a storage medium is also known. An IC chip is an example of the storage medium. The storage medium has an electrical contact surface configured to be in contact with a terminal portion provided at the image-forming apparatus. However, the electrical contact surface may be scraped with a portion of the image-forming apparatus during attachment of the developing cartridge to the image-forming apparatus.

In view of the foregoing, it is an object of the disclosure to provide an image-forming apparatus capable of reducing scraping to an electrical contact surface of a developing cartridge during attachment of the developing cartridge.

In order to attain the above and other objects, according to one aspect, the disclosure provides an image-forming apparatus including a developing cartridge, a drum cartridge, an electrical contact, a frame, a first guide portion and a second guide portion. The developing cartridge includes: a developing roller rotatable about a first rotation axis extending in a first direction; a casing configured to accommodate therein developing agent, and having one end portion in a second direction, the developing roller being positioned at the one end portion; a storage medium having an electrical contact surface; and a holder positioned at one end of the casing in the first direction and holding the electrical contact surface. The holder includes: a first outer surface holding the electrical contact surface and positioned at one side of the holder in a third direction crossing the electrical contact surface; a second outer surface positioned at another side of the holder in the third direction, and positioned away from the first outer surface in the third direction; and a resilient member positioned between the first outer surface and the second outer surface and configured to expand and contract in the third direction, the resilient member being connected to the first outer surface and to the second outer surface, a distance in the third direction between the first outer surface and the second outer surface being changed according to expansion and contraction of the resilient member. The drum cartridge includes: a photosensitive drum rotatable about a second rotation axis extending in the first direction; and a holder support portion configured to be in contact with the second outer surface. The electrical contact is configured to contact the electrical contact surface. The developing cartridge is attachable to the frame in a state where the developing cartridge is attached to the drum cartridge. The holder support portion is in contact with the second outer surface in an attached state of the developing cartridge to the frame in the state where the developing cartridge is attached to the drum cartridge. The frame is configured to allow the developing cartridge to move from a first position to a second position relative to the frame, and then from the second position to a third position relative to the frame during insertion of the developing cartridge into the frame. The first guide portion is configured to guide at least a portion of the first outer surface in a direction of the insertion of the developing cartridge into the frame. The first guide portion is in contact with the at least the portion of the first outer surface during movement of the developing cartridge from the first position to the second position. The second guide portion faces the electrical contact and the first guide portion and is positioned spaced away from the electrical contact and the first guide portion. The second guide portion is configured to guide at least a portion of the holder support portion toward the electrical contact during the movement of the developing cartridge from the first position to the second position. The second guide portion is also configured to release the contact between the at least the portion of the first outer surface and the first guide portion to allow the electrical contact surface to make contact with the electrical contact during movement of the developing cartridge from the second position to the third position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
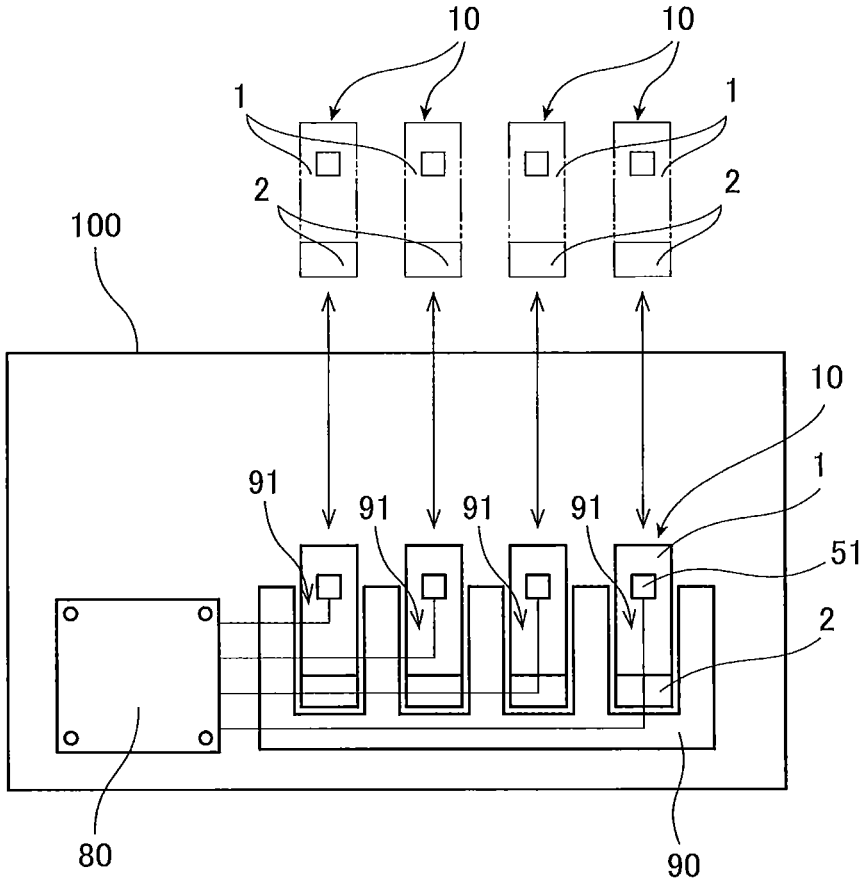
FIG. 1 is a conceptual diagram illustrating an image-forming apparatus according to one embodiment.

Hereinafter, embodiments of the present disclosure will be described in detail with reference to accompanying drawings, wherein like parts and components are designated by the same reference numerals to avoid duplicating description.

An image-forming apparatus 100 according to one embodiment will be described with reference to FIGS. 1 through 13.

<1. Overall Structure of Image-Forming Apparatus >

Referring to FIG. 1, the image-forming apparatus 100 is an electro-photographic type printer such as a laser printer and an LED printer.

The image-forming apparatus 100 includes four process cartridges 10 and a drum-cartridge holder 90. Each process cartridge 10 includes a developing cartridge 1 and a drum cartridge 2. The developing cartridge 1 is attachable to the drum cartridge 2. The four developing cartridges 1 respectively accommodate therein developing agent of different colors (for example, cyan, magenta, yellow and black). However, a number of the developing cartridge(s) 1 may be any one of one through three, and can be five or more. The drum-cartridge holder 90 is a frame to which the process cartridges 10 are attachable. The drum-cartridge holder 90 has four slots 91. Each process cartridge 10 can be attached to each slot 91. The image-forming apparatus 100 is configured to form an image on a recording surface of a sheet by the developing agents (such as toner) supplied from the four developing cartridges 1 of the four process cartridges 10.

Each developing cartridge 1 includes an IC chip 51 which is a storage medium from which information is readable and to which information is writable. The image-forming apparatus 100 includes a controller 80. Each IC chip 51 of each developing cartridge 1 is electrically connected to the controller 80 as a result of attachment of the process cartridge 10 to the slot 91. The controller 80 is constituted by, for example, a circuit board. The controller 80 includes a processor such as a CPU and various memories. The controller 80 controls various processing executed in the image-forming apparatus 100 by operations of the processor in accordance with operation programs.

<2. Process Cartridge >

<2-1. Developing Cartridge >

Figure 2:
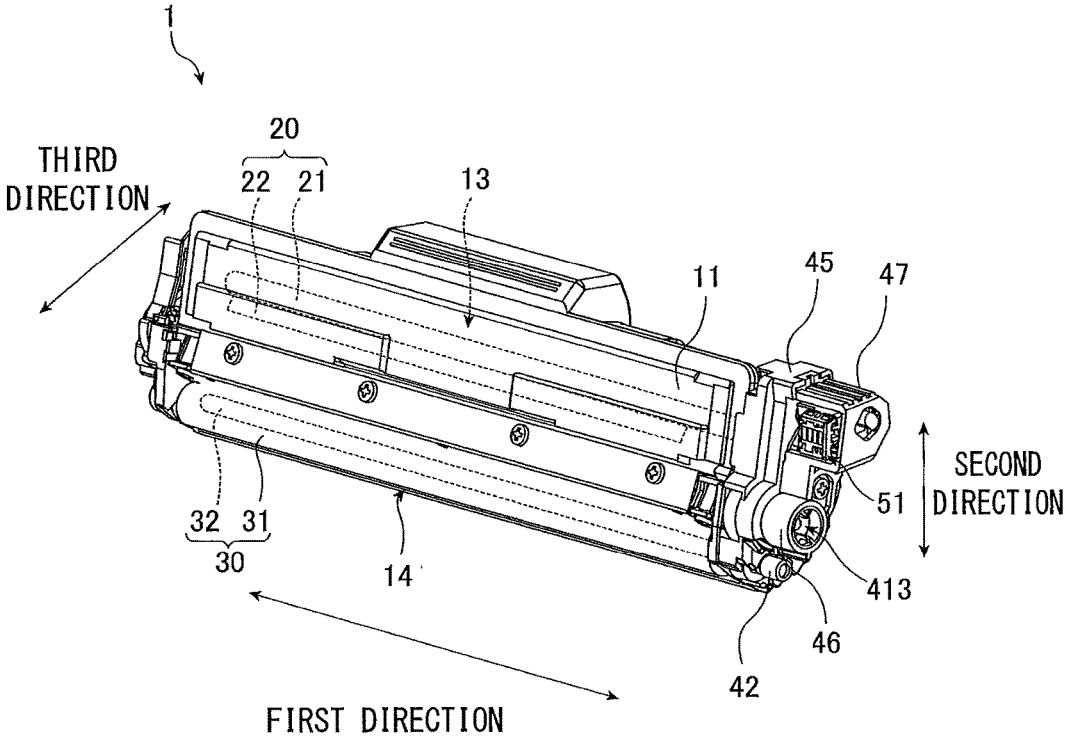
FIG. 2 is a perspective view of a developing cartridge according to the embodiment.
Figure 3:
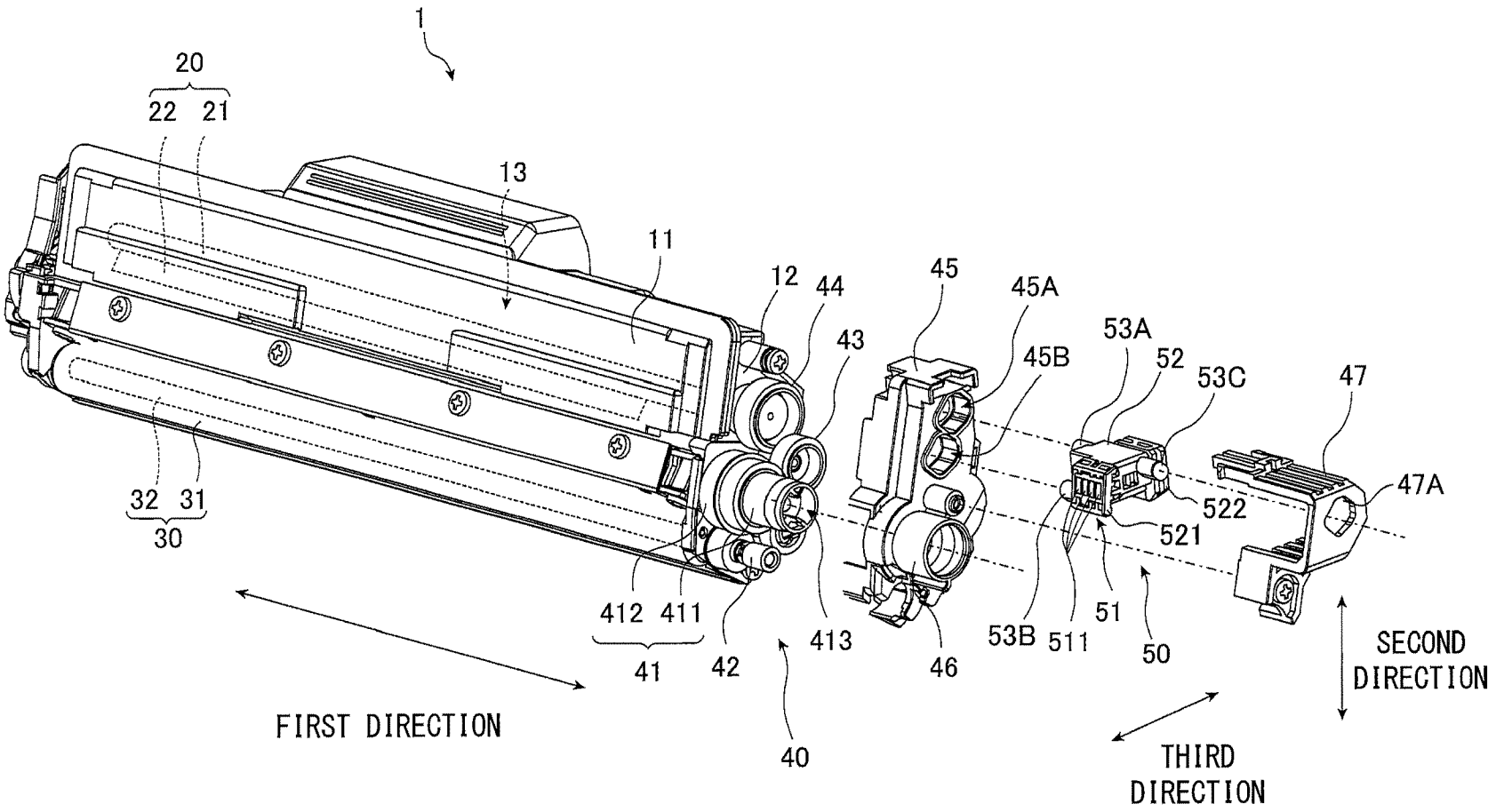
FIG. 3 is a partially exploded perspective view of the developing cartridge illustrated in FIG. 2.

In FIGS. 2 and 3, the developing cartridge 1 includes a casing 11, an agitator 20, a developing roller 30, a gear portion 40, and an IC chip assembly 50.

The casing 11 is a casing that extends in one direction and that accommodates developing agent. In the following description, the direction in which the casing 11 extends will be referred to as a "first direction". Further, a direction crossing the first direction will be referred to as a "second direction". Preferably, the second direction is perpendicular to the first direction. The developing roller 30 is positioned at one end portion of the casing 11 in the second direction. The second direction corresponds to a direction in which each process cartridge 10 is inserted into the corresponding slot 91 of the image-forming apparatus 100 (to be referred to as an "inserting direction", hereinafter). Further, a direction crossing the first direction and the second direction will be referred to as a "third direction". Preferably, the third direction is perpendicular to the first direction and the second direction. The third direction crosses the IC chip 51.

An accommodation chamber 13 is provided in an interior of the casing 11 for accommodating toner. The casing 11 has an opening 14 positioned at one end of the casing 11 in an attachment direction of the developing cartridge 1 to the drum cartridge 2. The accommodation chamber 13 communicates with an outside through the opening 14.

The agitator 20 includes an agitator shaft 21 and an agitation blade 22. The agitator shaft 21 extends in the first direction. The agitation blade 22 extends radially outwardly from the agitator shaft 21. At least a portion of the agitator shaft 21 and the agitation blade 22 are positioned inside the accommodation chamber 13. The agitator shaft 21 has one end portion in the first direction provided with an agitator gear 44 (described later). The agitator shaft 21 and the agitation blade 22 are rotatable along with rotation of the agitator gear 44. By the rotation of the agitation blade 22, the developing agent in the accommodation chamber 13 is agitated.

The developing roller 30 is rotatable about a rotation axis (first rotation axis) extending in the first direction. The developing roller 30 is positioned to face the opening 14 of the casing 11. The developing roller 30 includes a developing-roller body 31 and a developing-roller shaft 32. The developing-roller body 31 is a hollow cylindrical member extending in the first direction. The developing-roller body 31 is made from rubber having elasticity. The developing-roller shaft 32 is a solid cylindrical member extending through the developing-roller body 31 in the first direction. The developing-roller shaft 32 is made from metal or electrically conductive resin. The developing-roller body 31 is fixed to the developing-roller shaft 32 so as not to rotate relative to the developing-roller shaft 32.

The developing-roller shaft 32 has one end portion in the first direction fitted with a developing-roller gear 42 (described later). The developing-roller gear 42 is non-rotatably fixed to the one end portion of the developing-roller shaft 32. The developing-roller shaft 32 is rotatable by the rotation of the developing-roller gear 42 to rotate the developing-roller body 31.

Incidentally, the developing-roller shaft 32 does not necessarily extend throughout an entire length of the developing-roller body 31 in the first direction. For example, each developing-roller shaft 32 may extend in the first direction from each end of the developing-roller body 31 in the first direction.

The developing cartridge 1 further includes a supply roller (not illustrated) positioned between the developing roller 30 and the accommodation chamber 13. The supply roller is rotatable about a rotation axis extending in the first direction. Developing agent accommodated in the accommodation chamber 13 of the casing 11 is supplied to an outer peripheral surface of the developing roller 30 through the supply roller upon receipt of driving force in the developing cartridge 1. During the supply of the developing agent, the developing agent is tribo-electrically charged between the supply roller and the developing roller 30, while a bias voltage is applied to the developing-roller shaft 32 of the developing roller 30. Therefore, the developing agent is attracted to the outer peripheral surface of the developing-roller body 31 because of electrostatic force between the developing-roller shaft 32 and the developing agent.

The developing cartridge 1 further includes a layer-thickness regulation blade (not illustrated). The regulation blade is configured to form a toner layer on the outer peripheral surface of the developing-roller body 31 into a uniform thickness. Then, the developing agent on the outer peripheral surface of the developing-roller body 31 is supplied to a photosensitive drum 72 (described later) provided in the drum cartridge 2. In this instance, the developing agent is moved from the developing-roller body 31 to an electrostatic latent image formed at an outer peripheral surface of the photosensitive drum 72. Hence, the electrostatic latent image becomes a visible image at the outer peripheral surface of the photosensitive drum 72.

The gear portion 40 is positioned at a first end face 12 of the casing 11 in the first direction. As illustrated in FIG. 3, the gear portion 40 includes a coupling 41, the developing-roller gear 42, an idle gear 43, the agitator gear 44, and a cover 45. Incidentally, a plurality of gear teeth of each gear is omitted in FIG. 3.

The coupling 41 is a gear that is configured to firstly receive the driving force supplied from the image-forming apparatus 100. The coupling 41 is rotatable about a rotation axis extending in the first direction. The coupling 41 includes a coupling portion 411 and a coupling gear 412. The coupling portion 411 and the coupling gear 412 are integrally formed with resin. The coupling portion 411 has a coupling hole 413 recessed in the first direction. A plurality of gear teeth are provided at equal intervals over an entire outer peripheral surface of the coupling gear 412.

Upon attachment of the process cartridge 10 to the image-forming apparatus 100, a drive shaft (not shown) of the image-forming apparatus 100 is inserted into the coupling hole 413 of the coupling portion 411. Hence, the drive shaft and the coupling portion 411 are coupled together so as to avoid relative rotation therebetween. The coupling portion 411 rotates upon rotation of the drive shaft to rotate the coupling gear 412.

The developing-roller gear 42 is a gear for rotating the developing roller 30. The developing-roller gear 42 is rotatable about a rotation axis extending in the first direction. A plurality of gear teeth are provided at equi-intervals on an entire outer peripheral surface of the developing-roller gear 42. A portion of the gear teeth of the coupling gear 412 are in meshing engagement with a portion of the gear teeth of the developing-roller gear 42. Further, the developing-roller gear 42 is fixed to the one end portion of the developing-roller shaft 32 in the first direction so as not to rotate relative to each other. Hence, the developing-roller gear 42 rotates by the rotation of the coupling gear 412 to rotate the developing roller 30.

The idle gear 43 is a gear for transmitting rotation of the coupling gear 412 to the agitator gear 44. The idle gear 43 is rotatable about a rotation axis extending in the first direction.

The agitator gear is a gear for rotating the agitator 20 positioned in the accommodation chamber 13. The agitator gear 44 is rotatable about a rotation axis extending in the first direction. A plurality of gear teeth are provided at equi-intervals on an entire outer peripheral surface of the agitator gear 44. The agitator gear 44 is fixed to one end portion of the agitator shaft 21 in the first direction so as not to rotate relative to each other. Hence, the agitator gear 44 rotates upon receipt of driving force from the coupling 41 through the idle gear 43, to rotate the agitator 20.

The cover 45 is fixed to the first end face 12 of the casing 11 by, for example, screws. The coupling gear 412, the developing-roller gear 42, the idle gear 43, and the agitator gear 44 are accommodated in a space defined by the first end face 12 and the cover 45. The cover 45 includes a hollow cylindrical rib 46 extending in the first direction. The coupling portion 411 is fitted with the rib 46, and the coupling hole 413 is exposed to the outside of the cover 45. The developing cartridge 1 further includes a holder cover 47 fixed to the cover 45. The holder cover 47 is positioned opposite to the casing 11 with respect to the cover 45 in the first direction.

<2-2. IC Chip Assembly >

Figure 4:
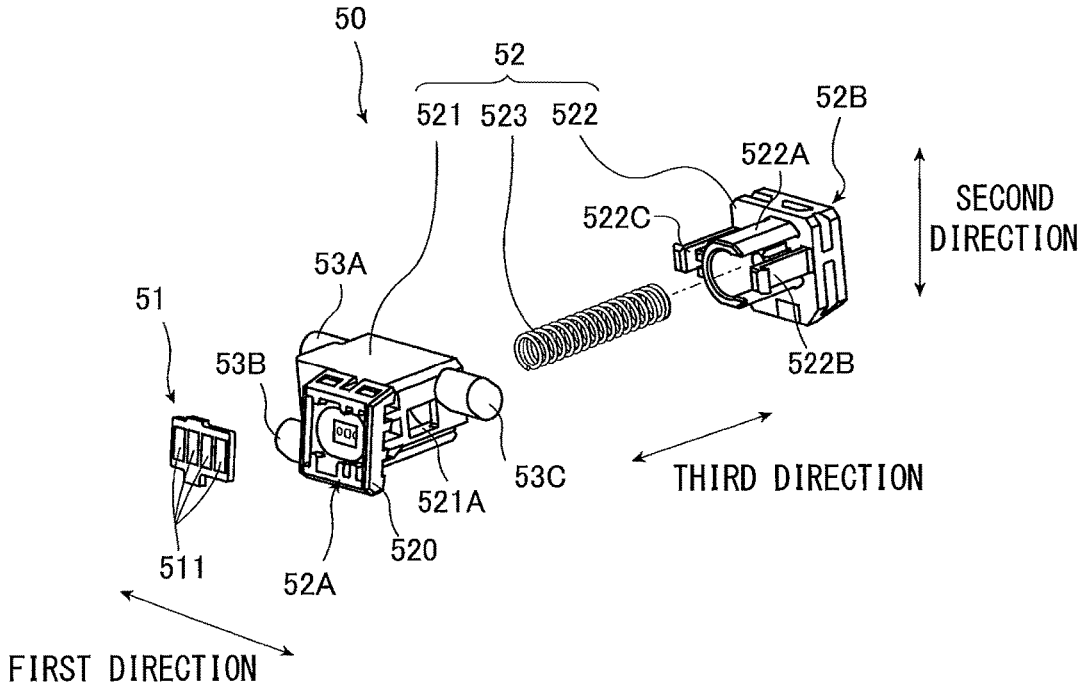
FIG. 4 is an exploded perspective view of an IC chip assembly in the developing cartridge according to the embodiment.

As illustrated in FIG. 4, the IC chip assembly 50 includes the IC chip 51 as the storage medium, and a holder 52 holding the IC chip 51. The IC chip 51 includes four electrical contact surfaces 511. Each electrical contact surface 511 is made from electrically conductive metal. The IC chip 51 is configured to store various information on the developing cartridge 1. However, the number of the electrical contact surface 511 may be one through three, or may be five or more.

The holder 52 has a first outer surface 52A and a second outer surface 52B. The first outer surface 52A and the second outer surface 52B are positioned at one end and another end of the holder 52 in the third direction, respectively. The first outer surface 52A is movable in the third direction relative to the second outer surface 52B.

More specifically, the holder 52 includes a first holder member 521, a second holder member 522, and a coil spring 523 interposed therebetween. The first holder member 521 and the second holder member 522 are made from resin. The first holder member 521 has the first outer surface 52A. The first outer surface 52A contains a holding surface 520 to which the IC chip 51 is fixed. The second holder member 522 has the second outer surface 52B. Upon assembly of the holder 52, the first outer surface 52A and the second outer surface 52B are away from each other in the third direction.

The coil spring 523 is a resilient member configured to expand and contract in the third direction. The coil spring 523 is positioned between the first outer surface 52A and the second outer surface 52B in the third direction. The coil spring 523 may be directly connected to the first outer surface 52A and the second outer surface 52B, or may be indirectly connected thereto through connection members. The coil spring 523 can expand and contract in the third direction at least between a first state and a second state providing higher contraction than the first state. The coil spring 523 has a length in the third direction in the first state greater than the length in the second state. Therefore, a distance between the first outer surface 52A and the second outer surface 52B in the third direction is greater in the first state than the distance in the second state. Further, the length of the coil spring 523 at least in the second state is smaller than a natural length of the coil spring 523.

A spring holder 522A having a hollow cylindrical shape protrudes from the second holder member 522 in the third direction. The coil spring 523 is inserted into the spring holder 522A. Incidentally, a cylindrical protrusion (not shown) is positioned in an internal space of the spring holder 522A. The cylindrical protrusion is inserted in a radially inner side of the coil spring 523. Thus, the coil spring 523 is supported by an outer peripheral surface of the cylindrical protrusion and an inner peripheral surface of the spring holder 522A.

A first pawl portion 522B and a second pawl portion 522C protrude from the second holder member 522 in a direction crossing the third direction. On the other hand, the first holder member 521 has a first opening 521A. The first pawl portion 522B is inserted into the first opening 521A. Further, the first holder member 521 also has a second opening (not shown). The second pawl portion 522C is inserted into the second opening.

In the first state, the first pawl portion 522B is in contact with the first holder member 521 at an edge of the first opening 521A, the edge being closer to the second outer surface 52B than an opposite edge is to the second outer surface 52B in the third direction. Further, in the first state, the second pawl portion 522C is in contact with the first holder member 521 at an edge of the second opening, the edge being closer to the second outer surface 52B than an opposite edge is to the second outer surface 52B in the third direction. This structure can prevent the length of the coil spring 523 in the third direction from becoming further longer than the length in the first state, maintaining the length of the coil spring 523 in the third direction in the first state. This structure can also prevent disengagement of the first holder member 521 from the second holder member 522. On the other hand, in the second state, the first pawl portion 522B and the second pawl portion 522C are separated from the first holder member 521.

As described above, the IC chip 51 is fixed to the holding surface 520 included in the first outer surface 52A of the first holder member 521. That is, the electrical contact surfaces 511 of the IC chip 51 is movable in the third direction in accordance with the movement of the first holder member 521 in the third direction relative to the second holder member 522. Incidentally, the IC chip 51 is fixed to a recessed position that is recessed in the third direction from the first outer surface 52A toward the second holder member 522.

The first holder member 521 includes bosses 53A, 53B and 53C. The bosses 53A and 53B are positioned at an outer surface of the first holder member 521, the outer surface facing the cover 45. The bosses 53A and 53B protrude in the first direction toward the cover 45 from the outer surface of the first holder member 521. On the other hand, the cover 45 has a through-hole 45A and a through-hole 45B extending through a thickness of the cover 45 in the first direction. The boss 53A is inserted into the through-hole 45A, and the boss 53B is inserted into the through-hole 45B.

The boss 53C is positioned at another outer surface of the first holder member 521, the outer surface facing the holder cover 47. The boss 53C protrudes in the first direction toward the holder cover 47 from the outer surface of the first holder member 521. On the other hand, the holder cover 47 has a through-hole 47A extending through a thickness of the holder cover 47 in the first direction. The boss 53C is inserted into the through-hole 47A.

The through-hole 47A has a dimension (inner dimension) in the second direction that is greater than a dimension (outer dimension) in the second direction of the boss 53C. The through-hole 45A has a dimension (inner dimension) in the second direction that is greater than a dimension (outer dimension) in the second direction of the boss 53A. The through-hole 45B has a dimension (inner dimension) in the second direction that is greater than a dimension (outer dimension) in the second direction of the boss 53B. Accordingly, the holder 52 is movable together with the bosses 53A, 53B and 53C in the second direction relative to the cover 45 and the holder cover 47. Thus, the IC chip 51 having the electrical contact surfaces 511 is movable in the second direction together with the holder 52 in accordance with the movement of the holder 52 in the second direction.

The through-hole 47A has a dimension (inner dimension) in the third direction that is greater than a dimension (outer dimension) in the third direction of the boss 53C. The through-hole 45A has a dimension (inner dimension) in the third direction that is greater than a dimension (outer dimension) in the third direction of the boss 53A. The through-hole 45B has a dimension (inner dimension) in the third direction that is greater than a dimension (outer dimension) in the third direction of the boss 53B. Accordingly, the holder 52 is movable together with the bosses 53A, 53B and 53C in the third direction relative to the cover 45 and the holder cover 47. Thus, the IC chip 51 having the electrical contact surfaces 511 is movable in the third direction together with the holder 52 in accordance with the movement of the holder 52 in the third direction.

Figure 5:
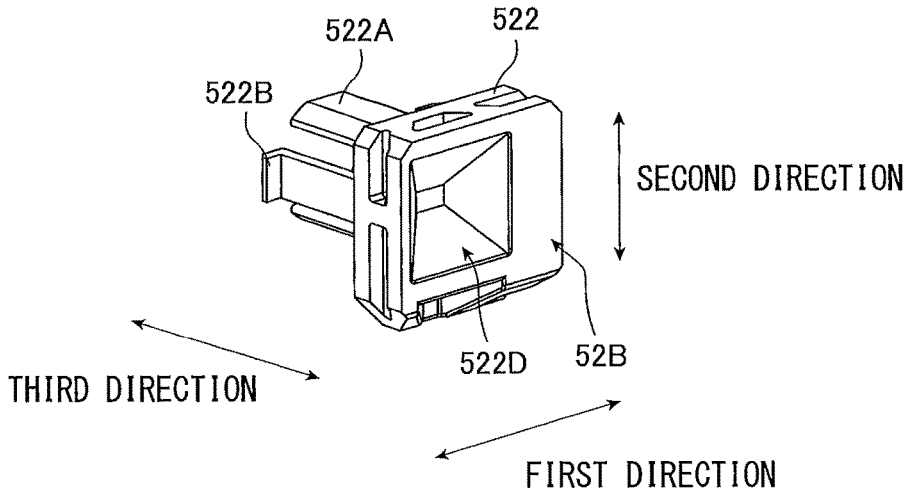
FIG. 5 is a perspective view illustrating a second holder member as viewed from one side of the second holder member opposite to another side thereof facing a first holder member in a third direction.

As illustrated in FIG. 5, the second outer surface 52B of the second holder member 522 has a recess 522D. The recess 522D is recessed toward the first holder 521 in the third direction and has a quadrangular pyramid shape such that a rectangular cross-sectional area is gradually reduced toward the first holder 521. On the other hand, the drum cartridge 2 includes a protruding portion 73 as described later with reference to FIG. 6. The protruding portion 73 is fitted with the recess 522D as a result of attachment of the developing cartridge 1 to the drum cartridge 2.

<2-3. Drum Cartridge >

Figure 6:
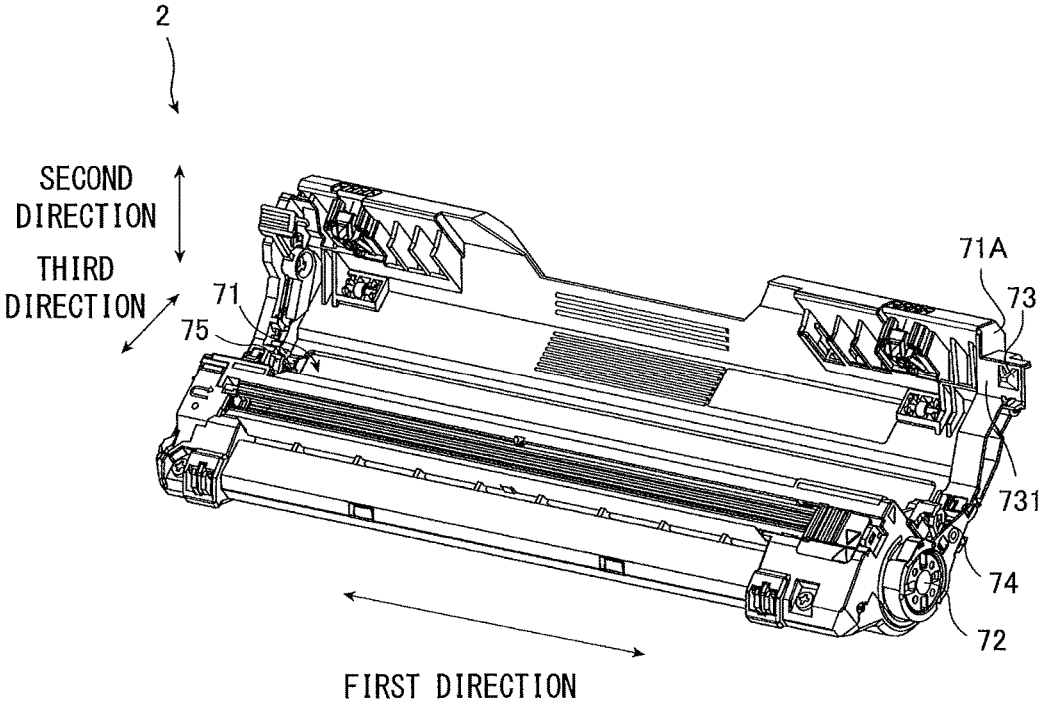
FIG. 6 is a perspective view of a drum cartridge according to the embodiment.

As illustrated in FIG. 6, the drum cartridge 2 includes a single developing-cartridge holding portion 71 for holding a single developing cartridge 1. The photosensitive drum 72 is positioned at the developing-cartridge holding portion 71. The photosensitive drum 72 is rotatable about a rotation axis (second rotation axis) extending in the first direction. The developing roller 30 of the developing cartridge 1 comes in contact with the photosensitive drum 72 as a result of attachment of the developing cartridge 1 to the drum cartridge 2. The drum cartridge 2 to which the developing cartridge 1 is attached is attached to the drum-cartridge holder 90 (FIG. 1) provided in the image-forming apparatus 100.

The developing-cartridge holding portion 71 has a first end surface 71A in the first direction provided with a holding plate 731. The holding plate 731 faces the second outer surface 52B of the holder 52 in the third direction in the attached state of the developing cartridge 1 to the drum cartridge 2. The holding plate 731 has a surface extending in the first direction and the second direction. The protruding portion 73 is provided at the surface. The protruding portion 73 protrudes from the surface of the holding plate 731 toward the holder 52 in the third direction. The protruding portion 73 has a quadrangular pyramid shape such that a rectangular cross-sectional area is gradually reduced toward the holder 52 in the third direction.

Figure 7:
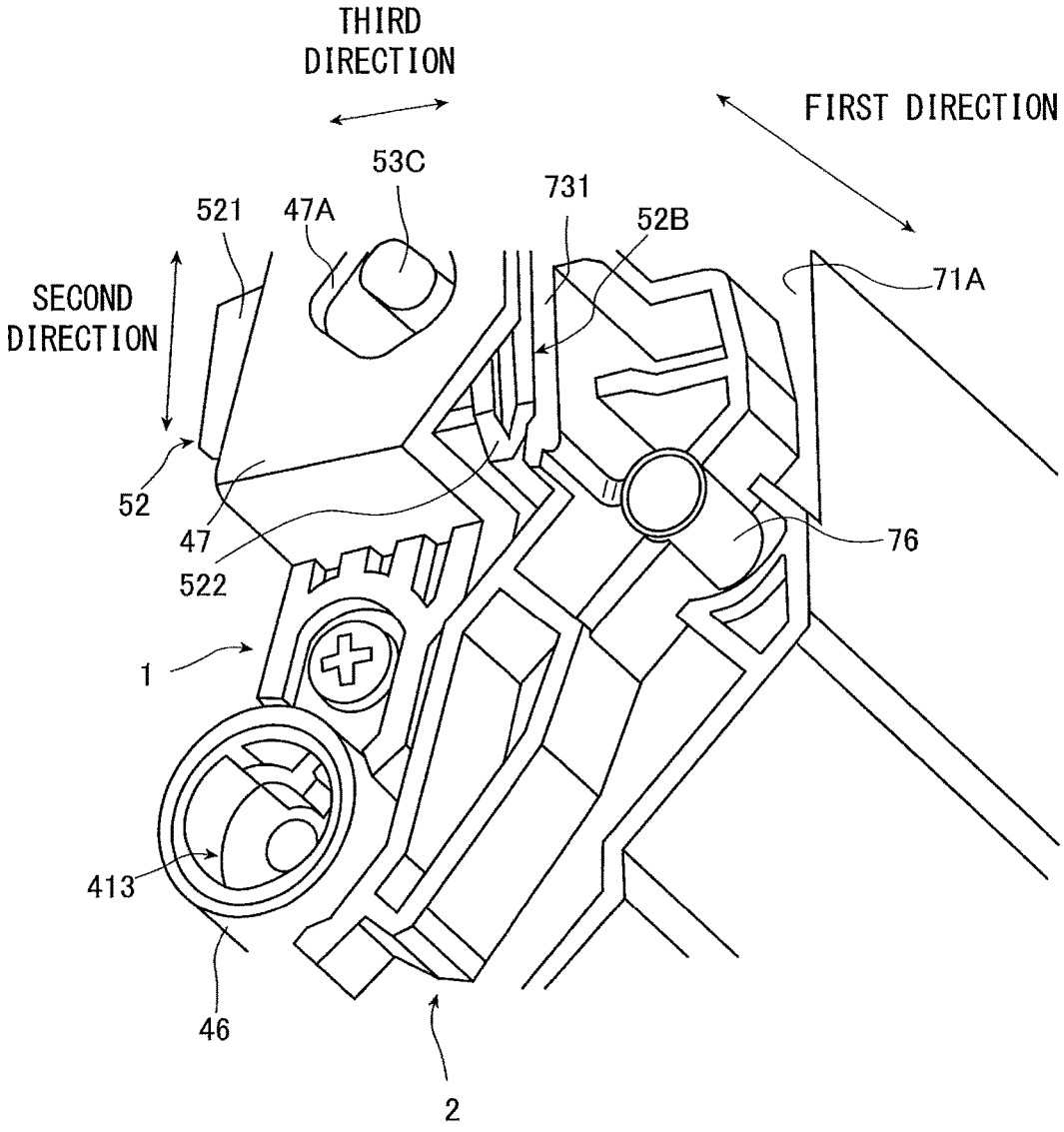
FIG. 7 is a partial perspective view illustrating an attachment state of the developing cartridge to the drum cartridge according to the embodiment.

As illustrated in FIG. 7, in the attached state of the developing cartridge 1 to the drum cartridge 2, the protruding portion 73 of the drum cartridge 2 is fitted with the recessed portion 522D of the second holder member 522, and the holding plate 731 of the drum cartridge 2 is in contact with the second outer surface 52B of the second holder member 522. That is, the holding plate 731 and the protruding portion 73 function as a holder supporting portion for holding the holder 52 of the IC chip assembly 50.

A cylindrical member 76 protrudes outward of the drum cartridge 2 in the first direction from the first end surface 71A. A protruding length of the holding plate 731 from the first end surface 71A in the first direction is greater than a protruding length of the cylindrical member 76 from the first end surface 71A in the first direction. Further, the cylindrical member 76 is positioned opposite to the holder 52 with respect to the holding plate 731.

The drum cartridge 2 further includes a first lever 74 and a second lever 75, as illustrated in FIG. 6. The first and second levers 74, 75 are operated to perform a so called "separating operation" in which the developing roller 30 is temporarily separated from the photosensitive drum 72 after attachment of the developing cartridge 1 to the drum cartridge 2. In the separating operation, the first and second levers 74, 75 are operated by the driving force from the image-forming apparatus 100. The first lever 74 pushes the rib 46 of the cover 45 as the first lever 74 is operated, and the second lever 75 pushes a rib (not illustrated) of the developing cartridge 1 as the second lever 75 is operated. Hence, the positions of the ribs of the developing cartridge 1 are changed. As a result, the casing 11 and the developing roller 30 of the developing cartridge 1 move away from the photosensitive drum 72 in the second direction.

<3. Drum-Cartridge Holder >

Figure 8:
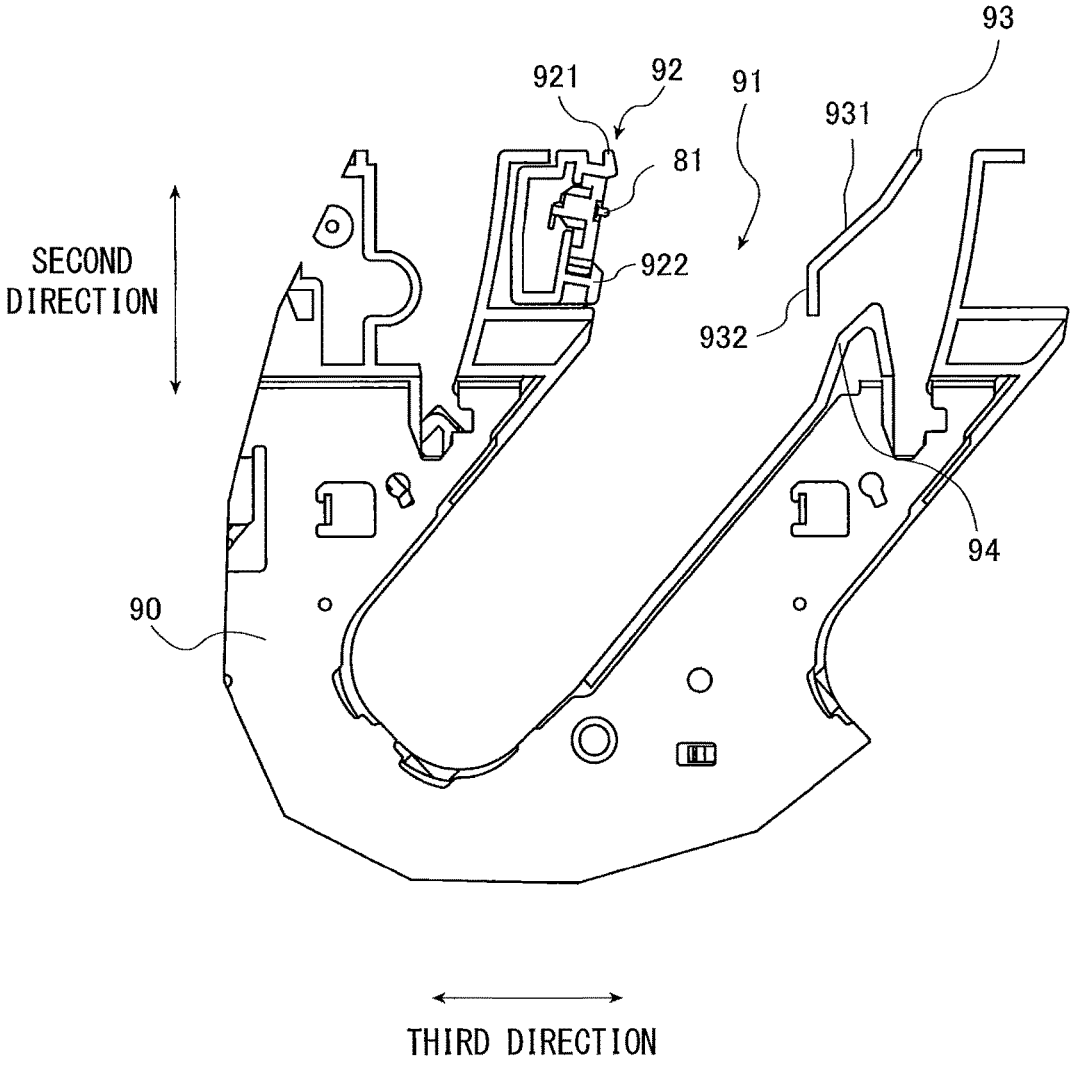
FIG. 8 is a cross-sectional view of a drum-cartridge holder in the image-forming apparatus according to the embodiment.

The drum-cartridge holder 90 is illustrated in FIG. 8. The drum-cartridge holder 90 has the four slots 91. FIG. 8 illustrates one of the slots 91.

The drum-cartridge holder 90 includes a first guide portion 92 and a second guide portion 93 for each of the slots 91. The first guide portion 92 and second guide portion 93 face each other and are spaced away from each other in the third direction at an insertion opening of each slot 91 through which the corresponding process cartridge 10 is inserted. The IC chip assembly 50 is inserted between the first guide portion 92 and the second guide portion 93 in the state where the process cartridge 10 is inserted into the corresponding slot 91.

The first guide portion 92 supports an electrical connector 81 made from metal. The electrical connector 81 is configured to contact the electrical contact surfaces 511 of the IC chip 51. The electrical connector 81 is an electrical contact protruding toward the second guide portion 93 from a surface of the first guide portion 92. The first guide portion 92 includes a first projection 921 and a second projection 922 arrayed with each other in the second direction. The electrical connector 81 is positioned between the first projection 921 and the second projection 922 in the second direction. The first projection 921 is positioned closer to the insertion opening in the second direction than the electrical connector 81 is to the insertion opening. The first and second projections 921, 922 protrude further toward the second guide portion 93 in the third direction than the electrical connector 81 does toward the second guide portion 93.

The second guide portion 93 includes a first guide plate 931 and a second guide plate 932. The first guide plate 931 is sloped relative to the second direction such that the first guide plate 931 extends toward the first guide portion 92 in the inserting direction of the process cartridge 10. The first guide plate 931 is configured to guide the holding plate 731 so that the holding plate 731 can approach the electrical connector 81 during insertion of the process cartridge 10. The second guide plate 932 is configured to guide the holding plate 731 in the inserting direction, after the holding plate 731 approaches the electrical connector 81 by the first guide plate 931.

The drum-cartridge holder 90 also includes a sloped plate 94 that is sloped relative to the second direction in a manner similar to the first guide plate 931. The sloped plate 94 is adapted to guide the cylindrical portion 76 of the drum cartridge 2 so that the cylindrical portion 76 moves toward the first guide portion 92 during insertion of the process cartridge 10 into the corresponding slot 91.

<4. Attachment of Process Cartridge >

Processes of insertion of the process cartridge 10 into the drum-cartridge holder 90 will be described next with reference to FIGS. 9 through 12.

<4-1. State of Process Cartridge Immediately after Insertion >

Figure 9:
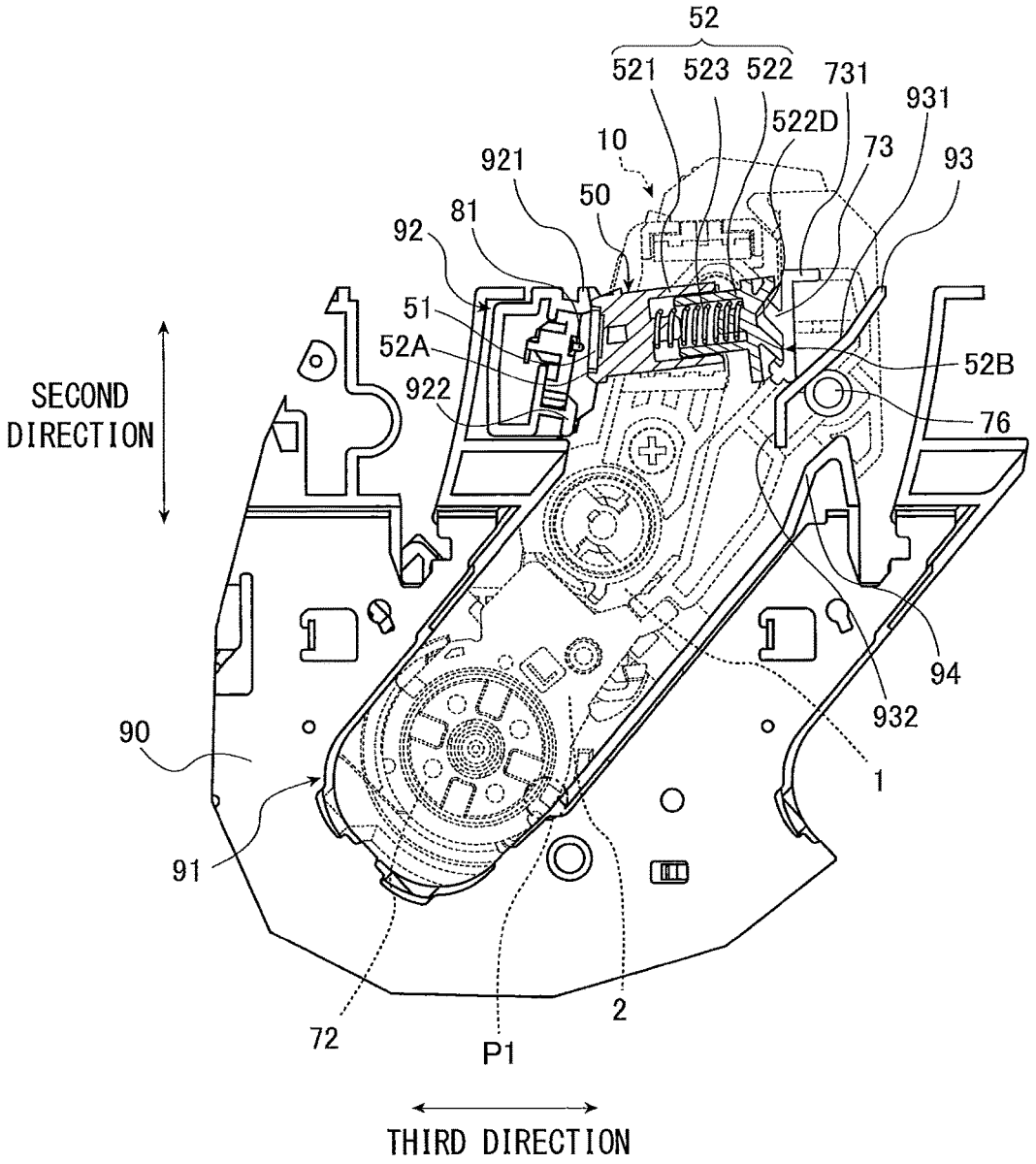
FIG. 9 is a view illustrating an initial state of attachment of a process cartridge (the developing cartridge attached to the drum cartridge) to the drum-cartridge holder in the image-forming apparatus according to the embodiment.

FIG. 9 illustrates a state immediately after the process cartridge 10 is inserted into the corresponding slot 91. The process cartridge 10 is inserted into the slot 91 of the drum-cartridge holder 90 in the second direction. In this instance, the IC chip assembly 50 is inserted between the first guide portion 92 and the second guide portion 93.

The first outer surface 52A of the first holder member 521 is brought into contact with the first projection 921 by the insertion of the process cartridge 10 into the slot 91. Further, the holding plate 731 is brought into contact with the first guide plate 931. In the following description, this position of the process cartridge 10 will be referred to as "first position". The coil spring 523 has a natural length (first length) in the third direction at the first position of the process cartridge 10.

In accordance with further insertion of the process cartridge 10 relative to the slot 91 in the inserting direction from the first position, the holding plate 731 is guided by the first guide plate 931 and moves toward the first guide portion 92 in the third direction. In accordance with the movement of the holding plate 731, the second holder member 522 also moves toward the first guide portion 92 in the third direction. In this case, movement of the first holder member 521 toward the first guide portion 92 in the third direction is prevented, since the first outer surface 52A of the first holder member 521 is in contact with the first projection 921. That is, the second holder member 522 approaches the first holder member 521 while compressing the coil spring 523.

One end portion of the photosensitive drum 72 in the first direction protrudes outward in the first direction, as illustrated in FIG. 6. On the other hand, the drum-cartridge holder 90 includes a frame (not illustrated) for guiding the process cartridge 10 inserted into the corresponding slot 91 in the inserting direction. The frame (not illustrated) is configured to contact an outer peripheral surface of the protruding portion of the photosensitive drum 72. In FIG. 9, the photosensitive drum 72 is in contact with the frame at a portion P1 encircled by a dotted chain line by the insertion of the process cartridge 10 into the slot 91. The photosensitive drum 72 slidingly moves along this frame (not illustrated), so that the process cartridge 10 can be guided in the inserting direction while being subjected to positioning in the third direction.

<4-2. State of Coil Spring Whose Length is Shorter than its Natural Length >

Figure 10:
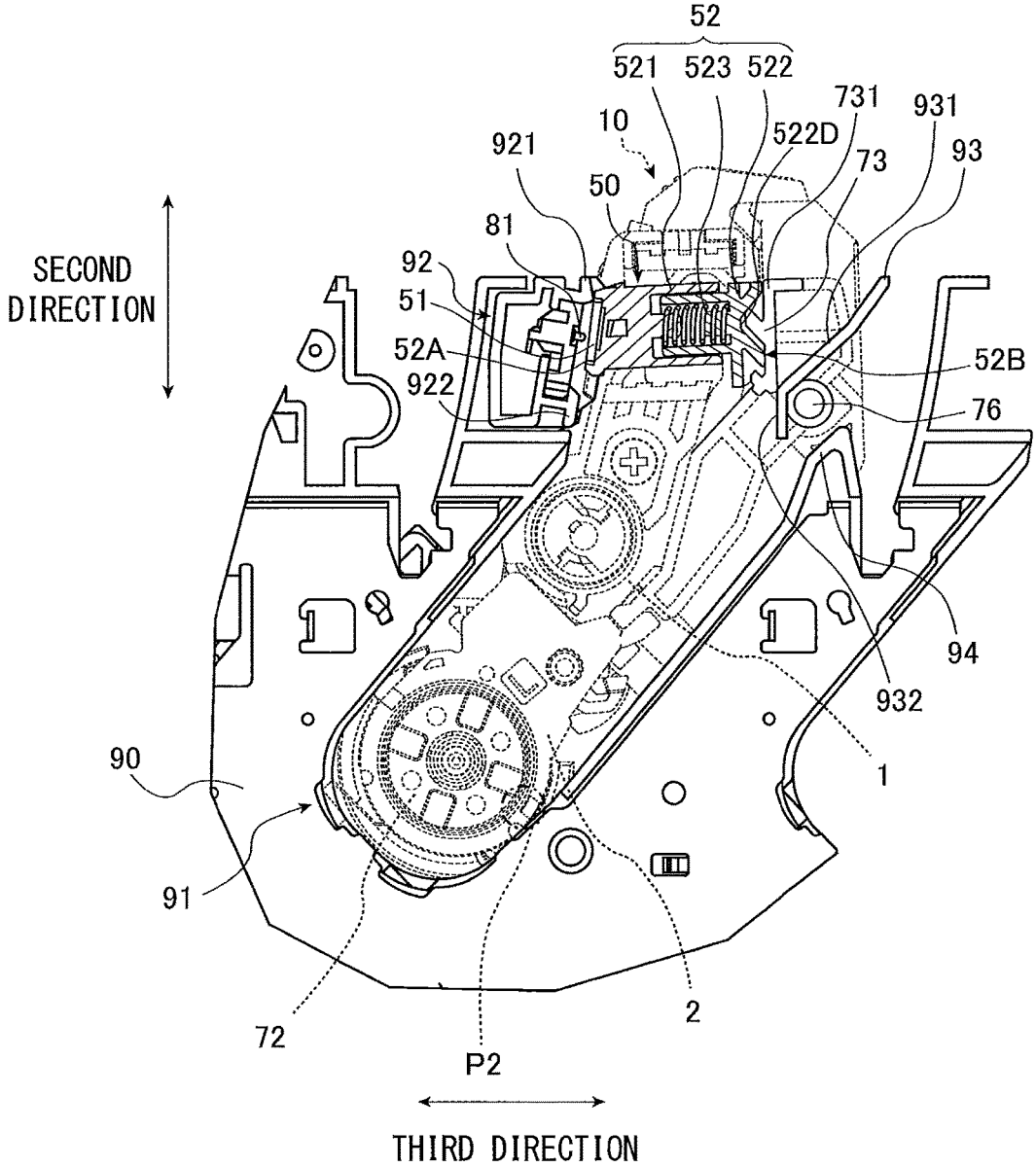
FIG. 10 is a view illustrating a state where the process cartridge is further inserted into the drum-cartridge holder in the image-forming apparatus according to the embodiment after the state of FIG. 9.

In FIG. 10, in accordance with further insertion of the process cartridge 10 in the inserting direction from the first position illustrated in FIG. 9, the holding plate 731 comes to oppose the second guide plate 932 in the third direction. In this case, the first outer surface 52A of the first holder member 521 remains in contact with the first projection 921. In the following description, this position of the process cartridge 10 will be referred to as "second position". A distance between the first outer surface 52A and the second outer surface 52B at the second position of the process cartridge 10 is smaller than the distance at the first position of the process cartridge 10. That is, the coil spring 523 has a second length in the third direction that is smaller than the natural length (first length).

In accordance with further insertion of the process cartridge 10 in the inserting direction from the second position, the holding plate 731 is guided by the second guide plate 932 and moves in the inserting direction. As described above, the second guide plate 932 extends in the second direction. Therefore, the holding plate 731 guided by the second guide plate 932 does not move in the third direction. Hence, the distance between the first outer surface 52A and the second outer surface 52B is maintained unchanged as long as the first outer surface 52A remains contacting with the first projection 921, even if the process cartridge 10 is further inserted in the inserting direction from the second position.

Further, as described above in connection with FIG. 9, the outer peripheral surface of the end portion of the photosensitive drum 72 contacts the frame (not illustrated) of the drum-cartridge holder 90 at a portion P2 encircled by a dotted chain line in FIG. 10. The photosensitive drum 72 slidingly moves along the frame (not illustrated), so that the process cartridge 10 can be guided in the inserting direction while being subjected to positioning in the third direction.

<4-3. Contact State of Electrical Contact Surfaces with Electrical Connector >

Figure 11:
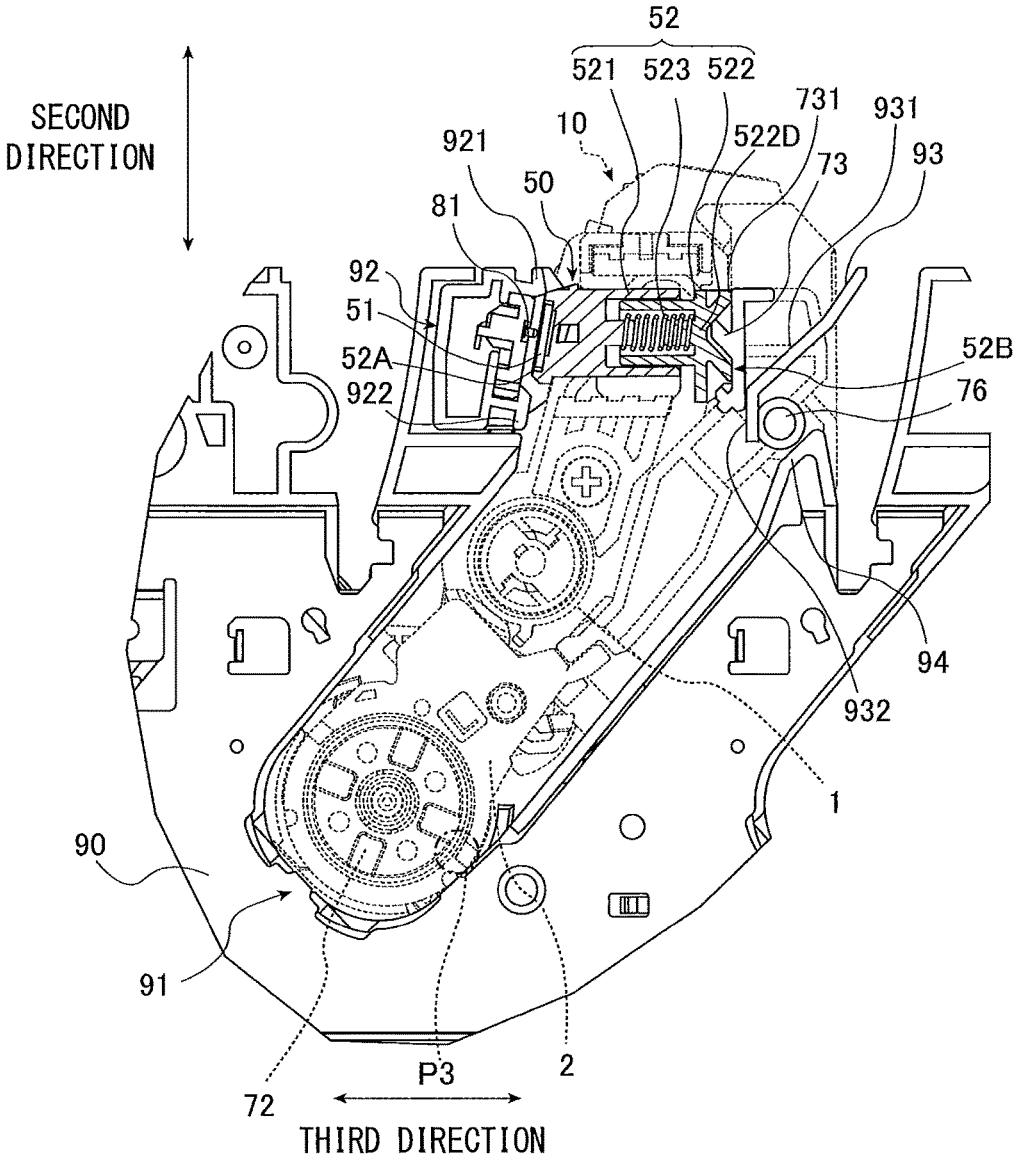
FIG. 11 is a view illustrating a state where the process cartridge is further inserted into the drum-cartridge holder in the image-forming apparatus according to the embodiment after the state of FIG. 10.

As illustrated in FIG. 11, in accordance with further insertion of the process cartridge 10 in the inserting direction from the second position illustrated in FIG. 10, the first holder member 521 moves past the first projection 921. Still, at this time, the holding plate 731 remains in contact with the second guide plate 932.

The first projection 921 prevents the first holder member 521 from moving toward the first guide portion 92 in the third direction until the first holder member 521 moves past the first projection 921. However, after the first holder member 521 moves past the first projection 921, since the first projection 921 no longer restricts the movement of the first holder member 521, the first holder member 521 moves toward the first guide portion 92 in the third direction because of the resiliency (restoration force) of the coil spring 523 whose length is smaller than its natural length. Hence, the electrical contact surfaces 511 of the IC chip 51 are brought into contact with the electrical connector 81. In the following description, this position of the process cartridge 10 will be referred to as "third position". The length of the coil spring 523 in the third direction at the third position is a third length that is greater than the second length.

In this way, the first outer surface 52A moves past the first projection 921 while changing the position of the first outer surface 52A in the third direction after contacting with the first projection 921. After the first outer surface 52A moves past the first projection 921, the electrical contact surfaces 511 are in direct contact with the electrical connector 81. Therefore, contact position of the electrical connector 81 with respect to the electrical contact surfaces 511 is less likely to deviate. Accordingly, scraping to the electrical contact surfaces 511 may be reduced.

Particularly, the electrical contact surfaces 511 of the IC chip 51 are positioned at a recessed position in the third direction on the first outer surface 52A. Therefore, the first projection 921 does not contact the electrical contact surfaces 511 in the states illustrated in FIGS. 9 through 11. Consequently, scraping to the first projection 921 relative to the electrical contact surfaces 511 can be obviated.

Further, as described above in connection with FIGS. 9 and 10, the outer peripheral surface of the end portion of the photosensitive drum 72 contacts the frame (not illustrated) of the drum-cartridge holder 90 at a portion P3 encircled by a dotted chain line in FIG. 11. The photosensitive drum 72 slidingly moves along the frame (not illustrated), so that the process cartridge 10 can be guided in the inserting direction while being subjected to positioning in the third direction.

<4-4. State of Completion of Attachment of Process Cartridge >

Figure 12:
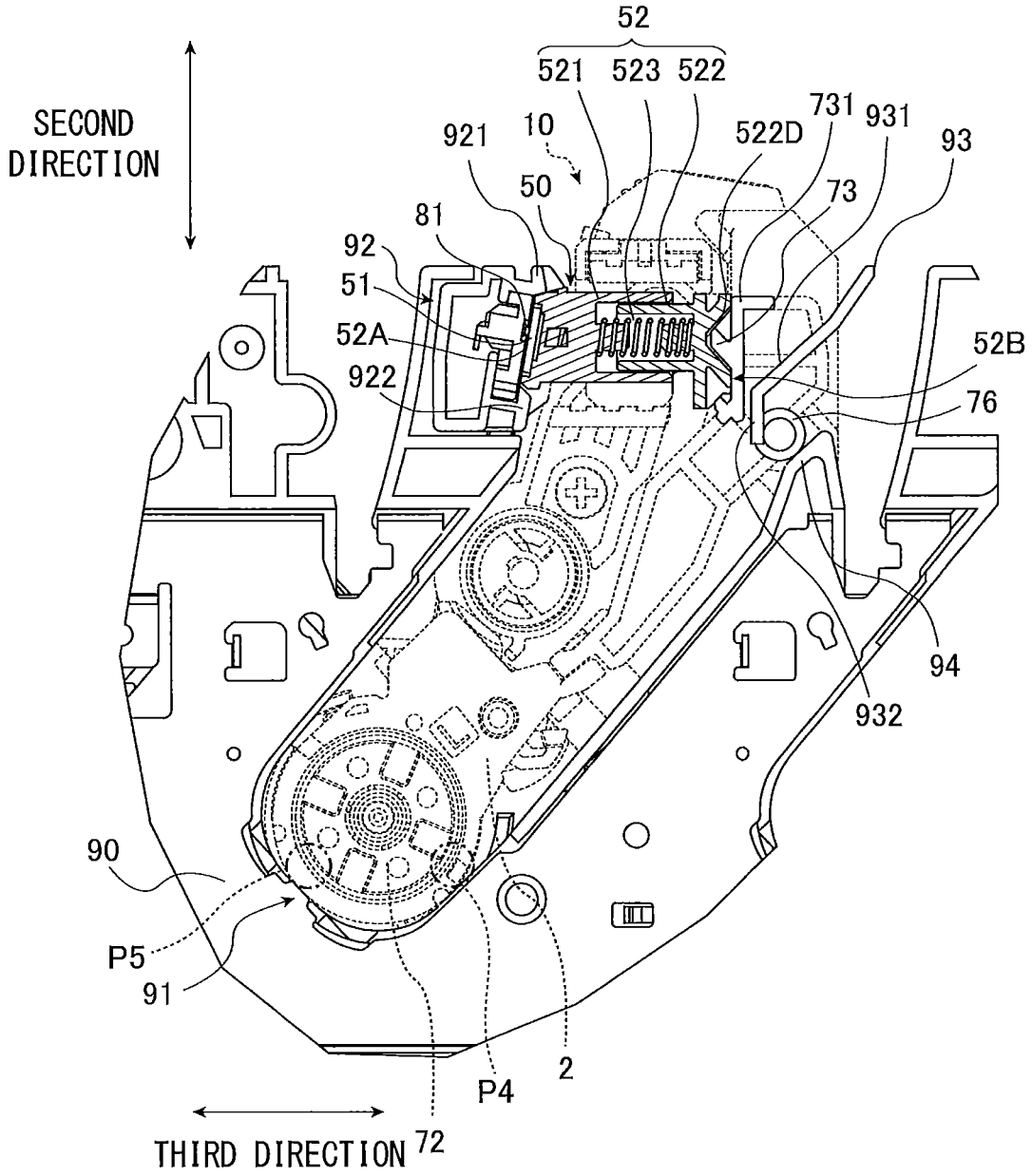
FIG. 12 is a view illustrating a state where the attachment of the process cartridge to the drum-cartridge holder is completed in the image-forming apparatus according to the embodiment.

As illustrated in FIG. 12, in accordance with further insertion of the process cartridge 10 in the inserting direction from the third position illustrated in FIG. 11, the first outer surface 52A of the holder 52 is brought into abutment with the second projection 922. Hence, movement of the first outer surface 52A in the second direction is stopped, and the cylindrical portion 76 of the drum cartridge 2 is brought into contact with the sloped plate 94. The cylindrical portion 76 is guided toward the first guide portion 92 in the third direction by the sloped plate 94. Thus, the process cartridge 10 moves toward the first guide portion 92 in the third direction, and the position of the process cartridge 10 in the third direction is fixed. That is, the cylindrical portion 76 and the sloped plate 94 perform positioning of the process cartridge 10 in the third direction.

In accordance with further insertion of the process cartridge 10 into the slot 91, the outer peripheral surface of the end portion of the photosensitive drum 72 is brought into contact with a plate (not illustrated) of the drum-cartridge holder 90 at a portion P5 encircled by two dotted chain line in FIG. 12. Thus, the movement of the process cartridge 10 inserted into the slot 91 in the inserting direction (second direction) is restrained by the contact of the end portion of the photosensitive drum 72 with the plate (not illustrated). Further, as described in connection with FIGS. 9 through 11, the photosensitive drum 72 is subjected to positioning in the third direction by the frame (not illustrated) of the drum-cartridge holder 90 at a portion P4 encircled by a dotted chain line in FIG. 12. That is, the positioning to the process cartridge 10 in the second direction and in the third direction is performed by the photosensitive drum 72 and the plate and the frame (both not illustrated) of the drum-cartridge holder 90 upon completion of attachment of the process cartridge 10 to the corresponding slot 91.

<4-5. State of Shipment of Image-Forming Apparatus >

Figure 13:
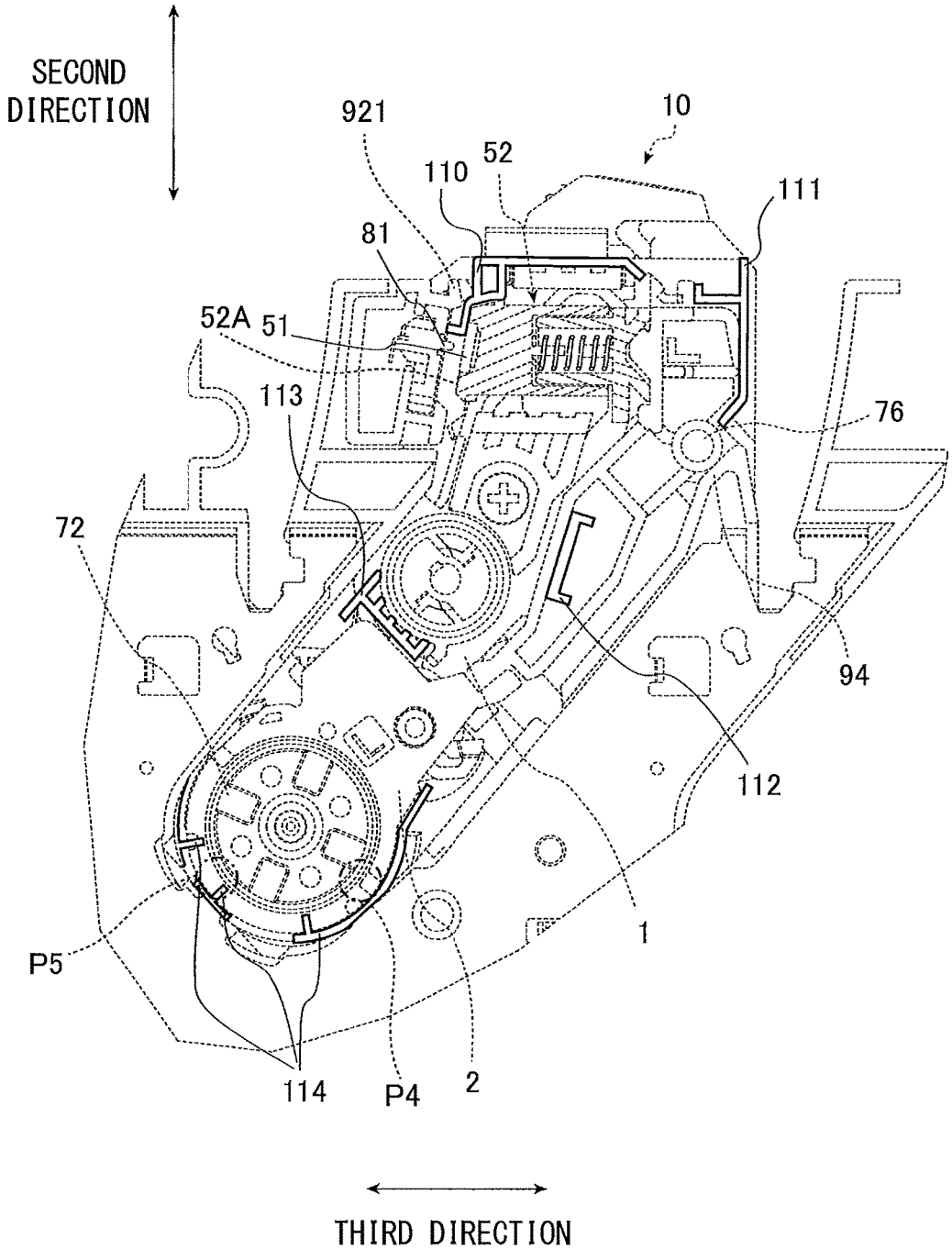
FIG. 13 is a view illustrating a state where the process cartridge is attached to the drum-cartridge holder at the time of shipment of the image-forming apparatus according to the embodiment.

In FIG. 13, upon completion of attachment of the process cartridge 10 relative to the drum-cartridge holder 90, the process cartridge 10 is subjected to positioning in the second direction and third direction by the plate, frame of the drum-cartridge holder 90, the photosensitive drum 72, the cylindrical portion 76, and the sloped plate 94, as described in connection with FIGS. 9 through 12. In this state, buffer members 110, 111, 112, 113 and 114 are disposed in the image-forming apparatus 100 at the time of shipment thereof in order to avoid displacement of parts and components during transportation. For example, the buffer member 110 holds the holder 52 so that the IC chip 51 and the electrical connector 81 are maintained to be separated from each other. Specifically, a portion of the buffer member 110 is nipped between the first projection 921 of the first guide portion 92 and the first outer surface 52A of the holder 52. The buffer members 111 and 112 hold the developing cartridge 1 relative to the drum cartridge 2. The buffer member 113 holds the developing roller 30 so that the developing roller 30 does not rotate. The buffer member 114 holds the photosensitive drum 72 so that the photosensitive drum 72 does not rotate.

<5. Modifications >

While the description has been made in detail with reference to the embodiment thereof, it would be apparent to those skilled in the art that many modifications and variations may be made therein without departing from the scope of the disclosure. Hereinafter, various conceivable modifications will be described.

According to the above-described embodiment, the first guide plate 931 has the generally flat contact surface that is inclined relative to the second direction and that can contact the holding plate 731. However, the contact surface of the first guide plate 931 may be a curved surface. Further, the sloped plate 94 has the generally flat contact surface that is inclined relative to the second direction and that can contact the cylindrical portion 76. However, the contact surface of the sloped plate 94 may be a curved surface.

Further, in the above-described embodiment, the coil spring 523 is employed as a resilient member. However, a leaf spring, a torsion spring and the like are also available instead of the coil spring 523.

Further, according to the above described embodiment, the IC chip 51 having the electrical contact surfaces 511 is fixed at the outer surface of the holder (first outer surface 52A). However, only the electrical contact surfaces 511 configured to contact the electrical connector 81 may be fixed to the outer surface of the holder (first outer surface 52A), while a remaining portion of the IC chip 51 other than the electrical contact surfaces 511 may be positioned at a different portion of the developing cartridge 1.

Further, each part and component constituting the image-forming apparatus may have a shape different from that of the above-described embodiments. Further, parts and components described in the specification may be appropriately combined as long as such combinations can avoid conflicting problems.

What is claimed is:

1. An image-forming apparatus comprising:

a developing cartridge comprising:

a developing roller rotatable about a first rotation axis extending in a first direction;

a casing configured to accommodate therein developing agent, and having one end portion in a second direction, the developing roller being positioned at the one end portion;

a storage medium having an electrical contact surface; and a holder positioned at one end of the casing in the first direction and holding the electrical contact surface, the holder including:

a first outer surface holding the electrical contact surface and positioned at one side of the holder in a third direction crossing the electrical contact surface;

a second outer surface positioned at another side of the holder in the third direction, and positioned away from the first outer surface in the third direction; and a resilient member positioned between the first outer surface and the second outer surface and configured to expand and contract in the third direction, the resilient member being connected to the first outer surface and to the second outer surface, a distance in the third direction between the first outer surface and the second outer surface being changed according to expansion and contraction of the resilient member;

a drum cartridge comprising:

a photosensitive drum rotatable about a second rotation axis extending in the first direction; and a holder support portion configured to be in contact with the second outer surface;

an electrical contact configured to contact the electrical contact surface;

a frame to which the developing cartridge is attachable in a state where the developing cartridge is attached to the drum cartridge, the holder support portion being in contact with the second outer surface in an attached state of the developing cartridge to the frame in the state where the developing cartridge is attached to the drum cartridge, the frame being configured to allow the developing cartridge to move from a first position to a second position relative to the frame, and then from the second position to a third position relative to the frame during insertion of the developing cartridge into the frame;

a first guide portion configured to guide at least a portion of the first outer surface in a direction of the insertion of the developing cartridge into the frame, the first guide portion being in contact with the at least the portion of the first outer surface during movement of the developing cartridge from the first position to the second position; and a second guide portion facing the electrical contact and the first guide portion and positioned spaced away from the electrical contact and the first guide portion, the second guide portion being configured to guide at least a portion of the holder support portion toward the electrical contact during the movement of the developing cartridge from the first position to the second position, the second guide portion being also configured to release the contact between the at least the portion of the first outer surface and the first guide portion to allow the electrical contact surface to make contact with the electrical contact during movement of the developing cartridge from the second position to the third position.

2. The image-forming apparatus according to claim 1, wherein the first guide portion is positioned closer to the second guide portion than the electrical contact is to the second guide portion.

3. The image-forming apparatus according to claim 1, wherein the first guide portion comprises a projection protruding toward the second guide portion.

4. The image-forming apparatus according to claim 3, wherein the projection is positioned closer to the second guide portion than the electrical contact is to the second guide portion.

5. The image-forming apparatus according to claim 1, wherein the resilient member has a first length in the third direction in a case where the developing cartridge is at the first position, and the resilient member has a second length smaller than the first length in the third direction in a case where the developing cartridge is at the second position, and the resilient member has a third length smaller than the first length and greater than the second length in the third direction in a case where the developing cartridge is at the third position.

6. The image-forming apparatus according to claim 1, wherein the second guide portion comprises a first guide plate configured to guide the developing cartridge during the movement of the developing cartridge from the first position to the second position, the first guide plate being sloped to extend toward the electrical contact in the direction of the insertion.

7. The image-forming apparatus according to claim 1, wherein the second guide portion comprises a first guide plate configured to guide the developing cartridge during the movement of the developing cartridge from the first position to the second position, a distance between the first guide plate and the electrical contact being reduced in the direction of the insertion.

8. The image-forming apparatus according to claim 1, wherein the second guide portion comprises a second guide plate configured to guide the developing cartridge during the movement of the developing cartridge from the second position to the third position.

9. The image-forming apparatus according to claim 1, wherein the drum cartridge comprises a cylindrical portion extending in the first direction, and wherein the frame has a sloped surface that is sloped relative to the third direction, the cylindrical portion being out of contact from the sloped surface during the movement of the developing cartridge from the first position to the second position, the sloped surface guiding the cylindrical portion toward the first guide portion after the developing cartridge moves from the second position to the third position.

* * * * *